US008468711B2

(12) United States Patent
Kim et al.

(10) Patent No.: US 8,468,711 B2
(45) Date of Patent: Jun. 25, 2013

(54) CLOTHES DRYER

(75) Inventors: Jae-Seok Kim, Gyeongsangnam-Do (KR); Ju-Han Yoon, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 12/934,223

(22) PCT Filed: Jun. 2, 2009

(86) PCT No.: PCT/KR2009/002936

§ 371 (c)(1), (2), (4) Date: Sep. 23, 2010

(87) PCT Pub. No.: WO2009/148251

PCT Pub. Date: Dec. 10, 2009

(65) Prior Publication Data

US 2011/0016736 A1 Jan. 27, 2011

(30) Foreign Application Priority Data

Jun. 3, 2008 (KR) ..... 10-2008-0052322

(51) Int. Cl.
*F26B 11/02* (2006.01)

(52) U.S. Cl.
USPC ..... 34/82; 34/595; 34/606; 68/12.23; 68/20; 134/12; 134/194

(58) Field of Classification Search
USPC ..... 34/82, 595, 601, 606, 610; 68/4, 68/12.22, 12.23, 18 F, 20; 134/120, 189, 134/194
See application file for complete search history.

(56) References Cited

U.S. PATENT DOCUMENTS

| | | | | |
|---|---|---|---|---|
| 3,402,576 | A * | 9/1968 | Krupsky | 68/4 |
| 3,648,381 | A * | 3/1972 | Fox | 34/82 |
| 3,722,106 | A * | 3/1973 | Takeyama et al. | 34/82 |
| 3,959,891 | A * | 6/1976 | Burkall | 34/82 |
| 4,638,573 | A * | 1/1987 | Nakamura et al. | 34/82 |
| 4,653,200 | A * | 3/1987 | Werner | 34/82 |
| 5,097,606 | A * | 3/1992 | Harmelink et al. | 34/467 |
| 5,664,339 | A * | 9/1997 | Swanson et al. | 34/82 |
| 6,434,857 | B1 * | 8/2002 | Anderson et al. | 34/595 |
| 6,954,995 | B2 * | 10/2005 | Kitamura et al. | 34/597 |
| 7,020,986 | B1 | 4/2006 | Nakai et al. | |
| 7,644,515 | B2 * | 1/2010 | Doh | 34/603 |
| 2004/0079121 | A1 * | 4/2004 | Yabuuchi et al. | 68/19.2 |

(Continued)

FOREIGN PATENT DOCUMENTS

| | | | |
|---|---|---|---|
| DE | 19752364 | A1 * | 5/1999 |
| EP | 0 504 000 | A1 | 9/1992 |

(Continued)

*Primary Examiner* — Steve M Gravini
(74) *Attorney, Agent, or Firm* — Birch, Stewart, Kolasch & Birch, LLP

(57) ABSTRACT

Disclosed is a clothes dryer, comprising: a body; a drum rotatably installed at the body; a duct for guiding air exhausted from the drum; and a filter assembly for filtering lint included in the air exhausted from the drum. The filter assembly includes a lint filter and a cover filter, and a lint collector encompassed by the lint filter and the cover filter. The clothes dryer includes sensing means for sensing whether the lint filter has been mounted to a precise position or not. The sensing means consists of a magnet mounted to a mesh frame of the lint filter, and a reed switch mounted to a cover guide.

8 Claims, 6 Drawing Sheets

U.S. PATENT DOCUMENTS

| | | | | |
|---|---|---|---|---|
| 2005/0160708 | A1 * | 7/2005 | Iantorno | 55/482 |
| 2011/0016736 | A1 * | 1/2011 | Kim et al. | 34/82 |

FOREIGN PATENT DOCUMENTS

| | | | | |
|---|---|---|---|---|
| JP | 04220299 | A | * | 8/1992 |
| KR | 1999-011129 | A | | 2/1999 |
| KR | 10-2004-0056808 | A | | 7/2004 |
| KR | 10-2005-0119258 | A | | 12/2005 |
| KR | 10-0630023 | B1 | | 9/2006 |
| KR | 10-0664507 | B1 | | 1/2007 |
| WO | WO 2009148251 | A2 | * | 12/2009 |

* cited by examiner

CLOTHES DRYER

TECHNICAL FIELD

The present invention relates to a clothes dryer having a filter for filtering lint, and more particularly, to a clothes dryer having a filter assembly capable of preventing lint from leaking through a gap of a filter installation space.

BACKGROUND ART

Generally, a clothes dryer serves to dry an object to be dried by absorbing moisture inside the object by blowing blast generated by an electric heater or a gas heater into a drum. According to a method for processing humid air generated when drying the object, the clothes dryer is largely classified into an exhaustion-type clothes dryer and a condensation-type clothes dryer.

According to the exhaustion-type clothes dryer, humid air exhausted from the drum is exhausted out of the clothes dryer. However, required is an exhaustion duct for exhausting moisture evaporated from inside of the drum to outside. Furthermore, since products generated after combustion, such as carbon monoxide, is also exhausted out, the exhaustion duct has to be installed with a length long enough to be extended to the outdoor.

According to the condensation-type clothes dryer, humid air exhausted from the drum is condensed by a heat exchanger thus to have moisture removed therefrom. Then, the dried air is re-sent into the drum for re-circulation. However, since flow of the dried air forms a closed loop, using gas as a heat source is not easy.

In order to solve the problems of the exhaustion-type clothes dryer and the condensation-type clothes dryer, a ductless clothes dryer has been proposed. More concretely, the ductless clothes dryer can be maintained with low costs by using gas as a heat source. Furthermore, an additional exhaustion duct extended to the outdoor with a long length is not required.

FIGS. 1 to 3 are views schematically showing a clothes dryer in accordance with the conventional art. The conventional clothes dryer comprises a body 110; a drum 120 rotatably installed at the body 110; a blast supply unit 140 for supplying hot air into the drum 120; a heat exchanger 150 for removing moisture included in air exhausted from the drum 120; a duct 180 for guiding air exhausted from the drum 120 into the heat exchanger 150; and a filter 200 installed at the duct 180, for filtering lint included in air exhausted from the drum 120. A door 111 through which clothes is introduced into the drum 120 is installed on a front surface of the body 110. And, inside the body 110, installed are a belt 131 for rotating the drum 120, and a motor 135 for providing a driving force to the belt 131. A pulley 137 for winding the belt 131 is installed on a shaft of the motor 135. The drum 120 is a box having an inner space into which an object to be dried, such as clothes, is introduced. A plurality of lifters 121 for lifting clothes are installed in the drum 120.

The clothes dryer shown in FIGS. 1 to 3 is a ductless clothes dryer. However, other types of clothes dryer having a difference from the ductless clothes dryer may be implemented. For instance, the exhaustion-type clothes dryer does not require a heat exchanger for removing moisture included in air exhausted from the drum 120.

The clothes dryer comprises a filter 200 for filtering lint included in air exhausted from the drum 120. The filter 200 is generally installed on a front surface of a body of the clothes dryer. More concretely, as shown in FIG. 1, the filter 200 is installed below a door mounting position of the body of the clothes dryer.

The filter 200 is composed of a lint filter 310 having a mesh portion, and a cover filter 320 disposed above the lint filter and coupled to the lint filter. FIG. 4 shows the lint filter 310, whereas FIG. 5 shows the cover filter 320.

The lint filter 310 consists of a mesh portion 310*a* formed at a central part thereof, and an edge portion 310*b* configured to encompass the mesh portion 310*a*. The cover filter 320 is provided with holes 320*a* at an upper part thereof. The cover filter 320 is coupled to an upper surface of the lint filter 310, thus to be mounted to a front surface of the body of the clothes dryer. And, the air exhausted from the drum 120 flows to a lower side of the cover filter 320 through the holes 320*a* formed at an upper part of the cover filter 320, i.e., flows towards the lint filter 310. And, while passing through the mesh portion 310*a* of the lint filter 310, lint included in the air is filtered.

FIG. 6 shows the inside of the clothes dryer, in which the lint filter 310 and the cover filter 320 are coupled to each other to be mounted to the clothes dryer. And, FIGS. 7A to 7C are enlarged views of a first duct 210, a second duct 220, and the lint filter 310.

Referring to FIGS. 6 and 7, the lint filter 310 and the first duct 210 are mounted so as to be adhered to each other, thereby preventing leakage of lint therebetween. The flow of the air exhausted from the drum 120 will be explained. The air having high-temperature and high-humidity and including lint therein flows downwardly through the holes 320*a* formed at an upper part of the cover filter 320, thereby being positioned between the first duct 210 and the lint filter 310. Then, the air is exhausted to a space between the first and second ducts 210, 220 via the mesh portion 310 of the lint filter 310. Here, the air can pass through a gap of the mesh portion 310*a* of the lint filter 310, whereas lint included in the air can not pass through the gap thus to be collected to a space between the lint filter 310 and the first duct 210. And, the air having lint removed therefrom flows to a blowing fan through a discharge passage 230 of the first duct 210, via a space between the first and second ducts 210, 220.

In order to effectively remove lint included in the air exhausted from the drum 120, a sealing process between the first duct 210 and the lint filter 310 has to be executed more effectively. However, since the first duct 210 and the lint filter 310 do not have a perfectly sealed state therebetween, lint may be discharged out through a gap therebetween. The reasons why the first duct 210 and the lint filter 310 do not have a perfect sealed state are as follows.

Firstly, the lint filter 310 is formed of plastic, whereas the first duct 210 where the lint filter 310 is installed is formed of an iron plate. Due to the materials different each other, it is not easy to fabricate the first duct 210 and the lint filter 310 in the same shape.

Secondly, as shown in FIG. 7, the first duct 210 has to be provided with a round-shaped protrusion 320 so as to mount a cabinet cover thereon. This may cause a gap 330 to be generated between the first duct 210 and the lint filter 310.

In the clothes dryer, it is important to remove lint by the filter. Accordingly, if the clothes dryer operates in a state that the filter for removing lint has not been mounted therein, lint is accumulated on a passage inside the clothes dryer. This may degrade the function of the clothes dryer. However, the conventional clothes dryer is not provided with means to inform a user whether the filter has been mounted to a precise position or not. In this case, the clothes dryer may operate in a state that the filter has not been mounted therein.

DISCLOSURE OF THE INVENTION

Therefore, it is an object of the present invention to provide a clothes dryer capable of preventing lint from leaking through a gap of a filter installation space, and capable of providing means to inform whether a filter has been mounted to a precise position or not.

To achieve these and other advantages and in accordance with the purpose of the present invention, as embodied and broadly described herein, there is provided a clothes dryer, comprising: a body; a drum rotatably installed at the body; a duct for guiding air exhausted from the drum; and a filter assembly disposed at the duct, for filtering lint included in the air exhausted from the drum, wherein the filter assembly comprises a lint filter 510 and a cover filter 520; and a lint collector encompassed by the lint filter 510 and the cover filter 520, and configured to collect lint included in the air exhausted from the drum.

The lint filter 510 may consist of a mesh portion 510*a*, and a mesh frame 510*b* configured to encompass the mesh portion 510*a*. And, the cover filter 520 may consist of an upper side member having holes 520*a* through which the air exhausted from the drum is introduced into the filter assembly, and a lower side member downwardly extending from the upper side member and constituting a part of the lint collector.

The lower side member of the cover filter may consist of a plate 520*b* downwardly extending from the upper side member, and a plate frame 520*c* protruding from the plate 520*b* and encompassing the plate 520*b*.

The filter assembly may further comprise a cover guide 530 coupled to the cover filter 520 in a state that the lint filter 510 is disposed between the cover filter 520 and the cover guide 530. This may enhance a sealing state for lint collection.

The filter assembly may further comprise sensing means for sensing whether the lint filter has been mounted to a precise position or not. The sensing means may consist of a magnet 610 mounted to the mesh frame 510*b* of the lint filter 510, and a reed switch 620 mounted to the cover guide 530 or the cover filter 520.

In the present invention, the lint filter inserted into the clothes dryer may be configured to contact the cover guide, thereby effectively sealing a part where the filter assembly is to be installed. This may prevent lint from leaking through a gap of the filter assembly position, and may allow a user to easily recognize whether the lint filter has been mounted to a precise position or not before the clothes dryer operates.

MODES FOR CARRYING OUT THE PREFERRED EMBODIMENTS

Reference will now be made in detail to the preferred embodiments of the present invention, examples of which are illustrated in the accompanying drawings.

Hereinafter, a filtering structure for a clothes dryer, and a clothes dryer having the same according to the present invention will be explained in more detail with reference to the attached drawings.

The clothes dryer according to the present invention comprises a filter assembly for filtering lint included in air exhausted from a drum rotatably installed in a body.

Figure 1:
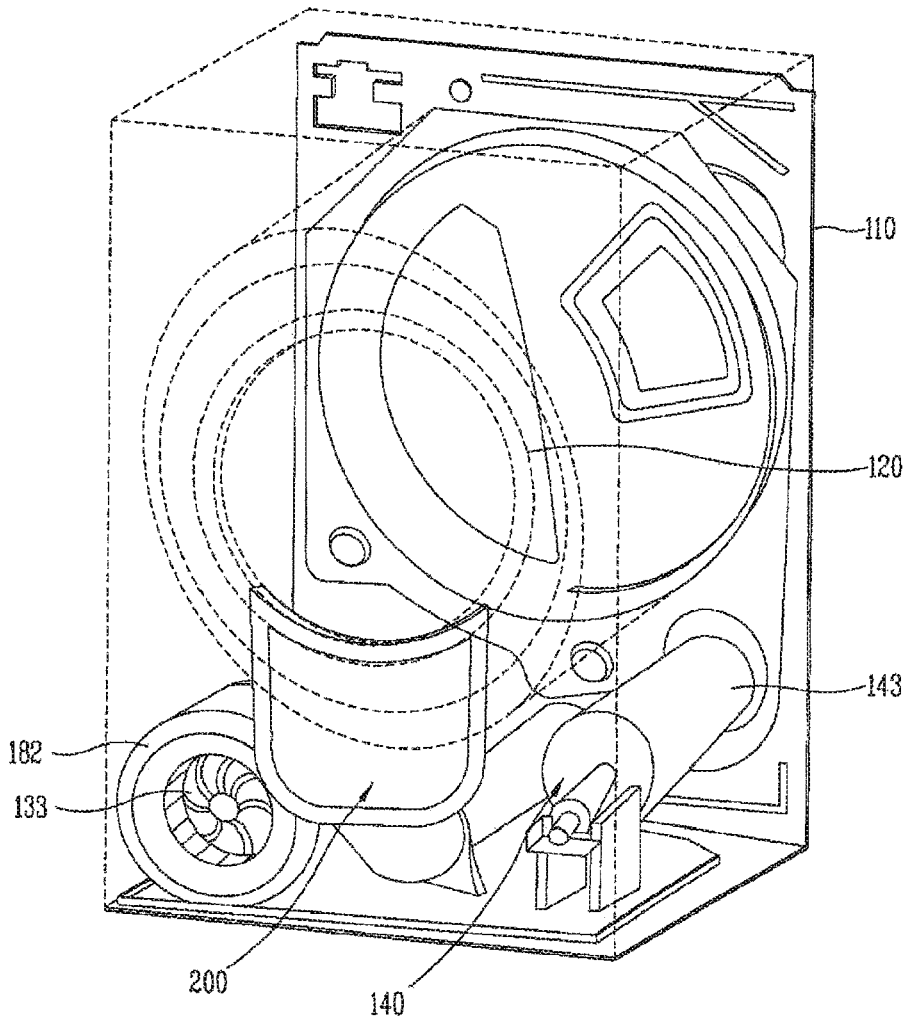
FIG. 1 is a perspective view schematically showing a clothes dryer in accordance with the conventional art.
Figure 2:
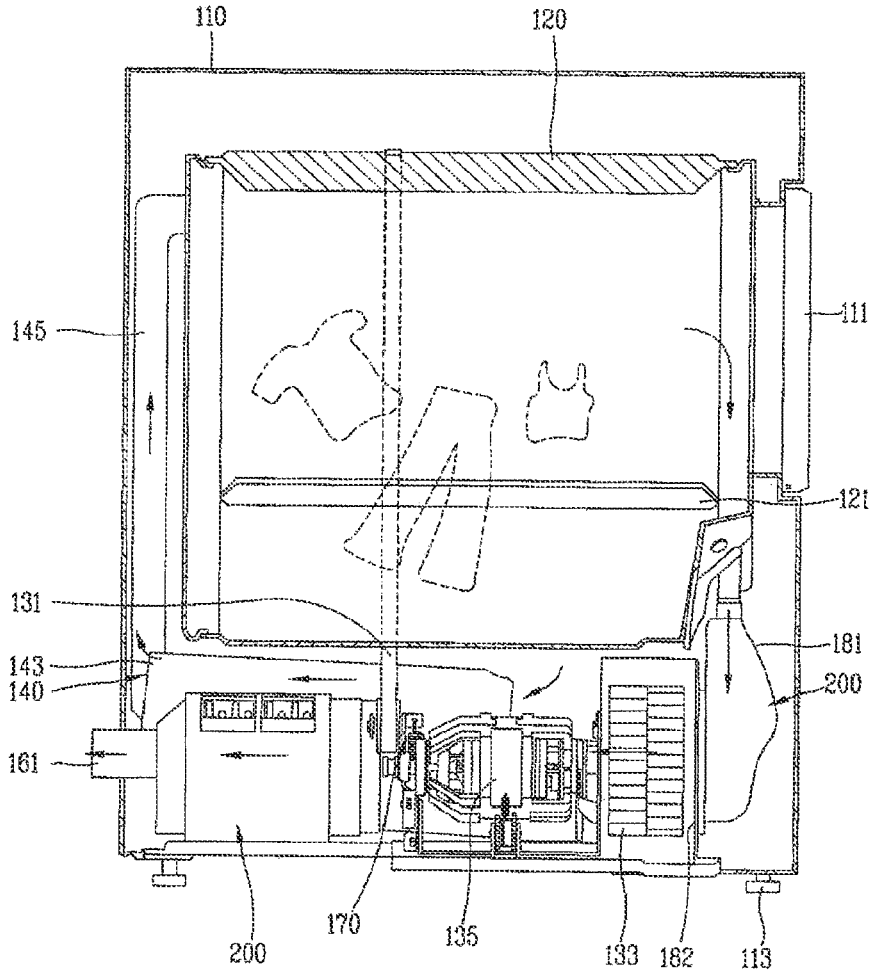
FIG. 2 is a side sectional view showing the inside of the clothes dryer of FIG. 1.
Figure 3:
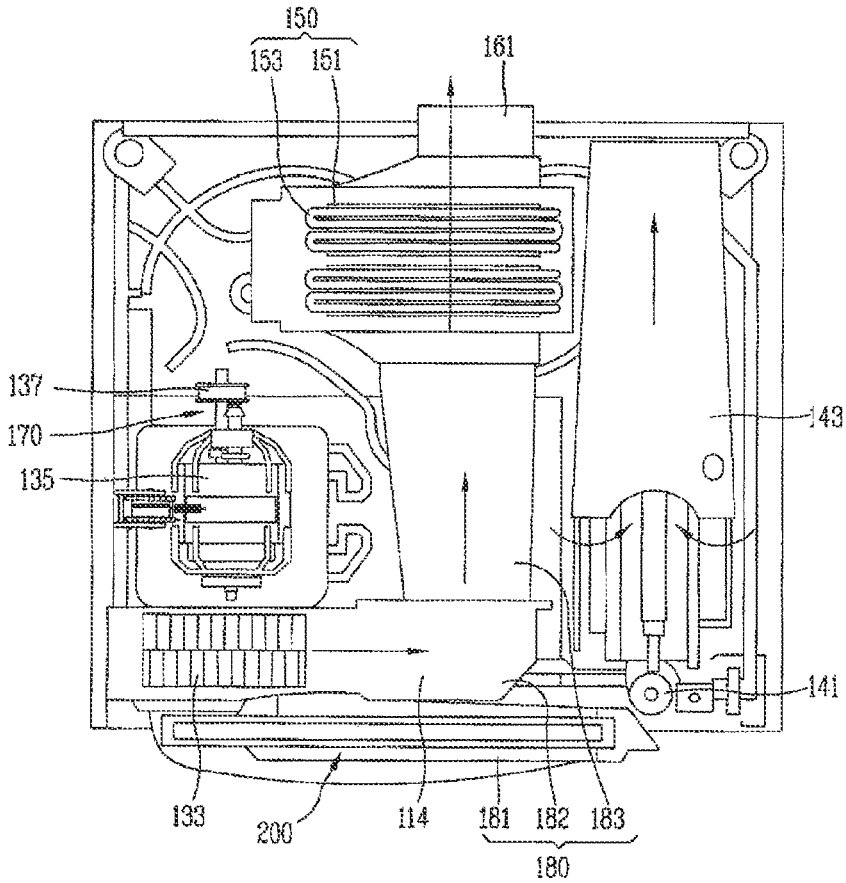
FIG. 3 is a view showing a lower structure of the inside of the clothes dryer of FIG. 1.
Figure 4:
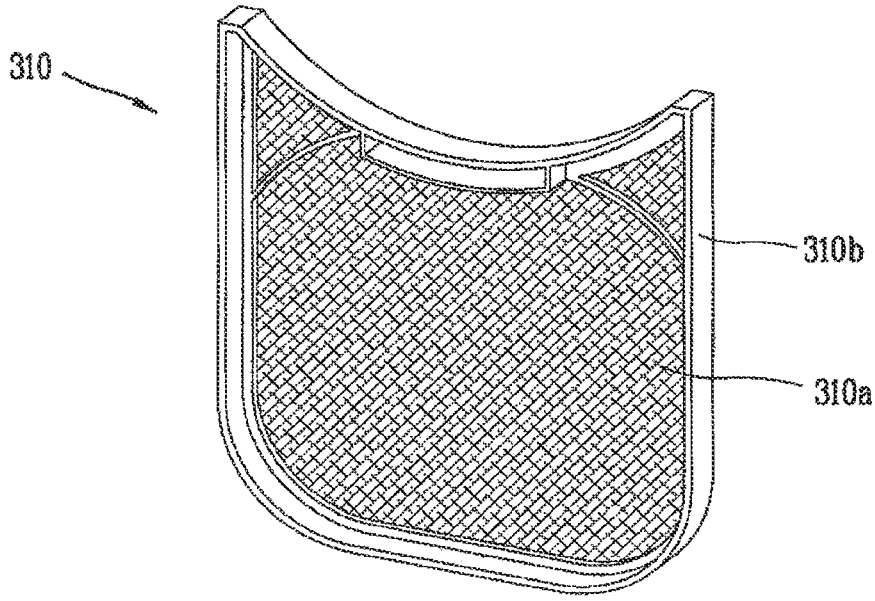
FIG. 4 is a perspective view of a lint filter installed at the clothes dryer of FIG. 1.
Figure 5:
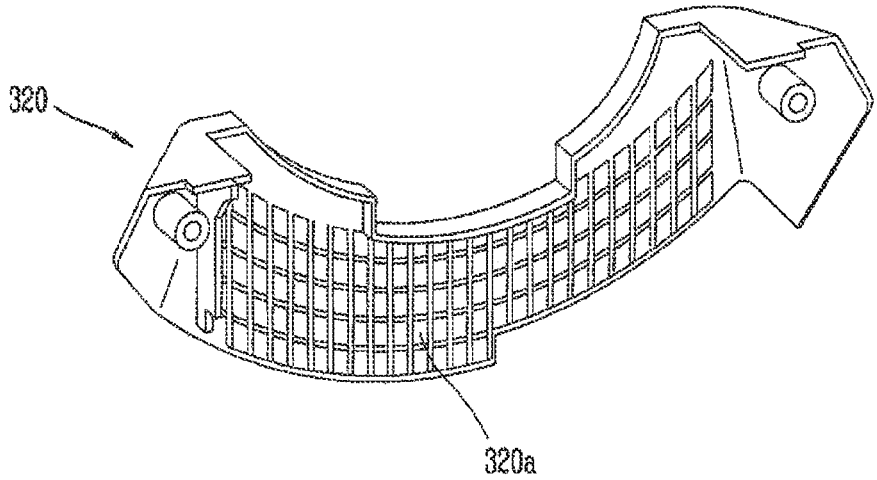
FIG. 5 is a perspective view of a cover filter installed at the clothes dryer of FIG. 1.
Figure 6:
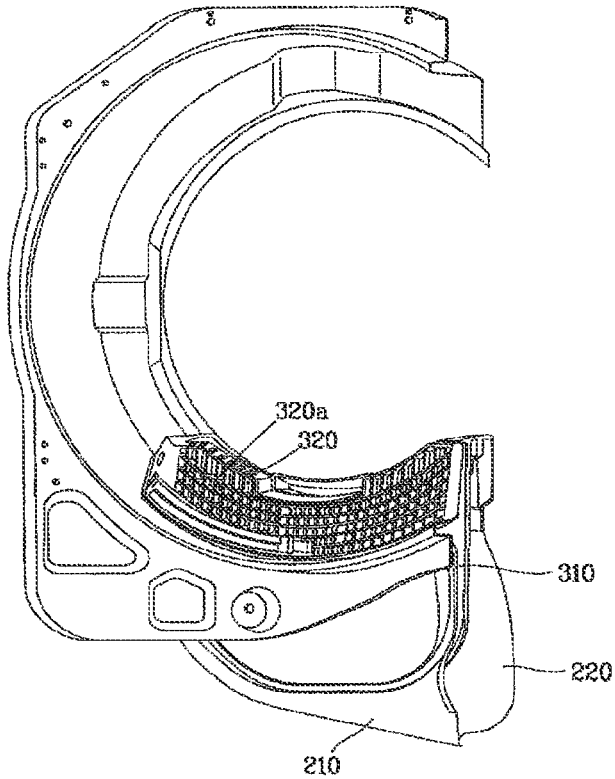
FIG. 6 is a view showing a state that a filter has been installed at the clothes dryer of FIG. 1.
Figure 7:
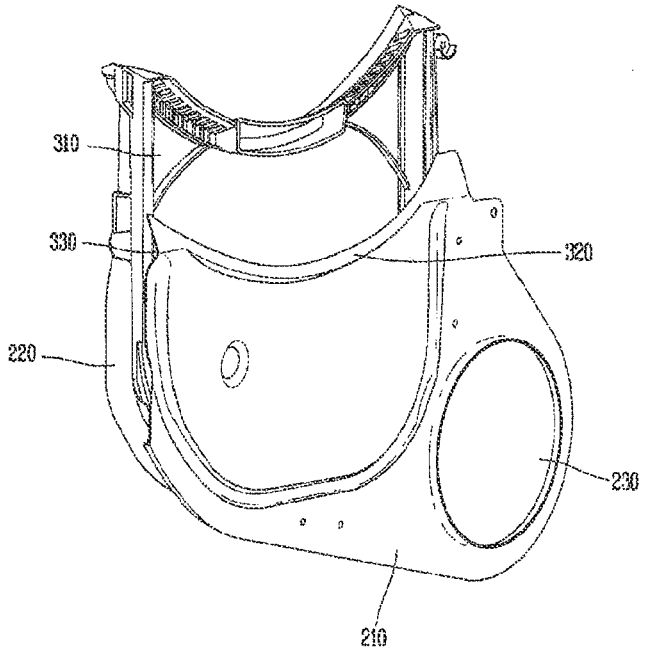
FIG. 7 is a perspective view showing partial structures of FIG. 6.
Figure 8:
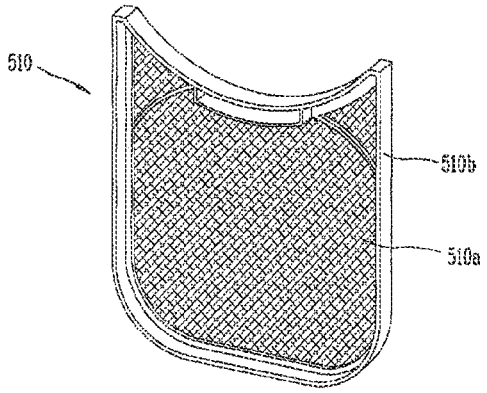
FIG. 8 is a perspective view showing a lint filter installed at a clothes dryer according to the present invention.
Figure 9:
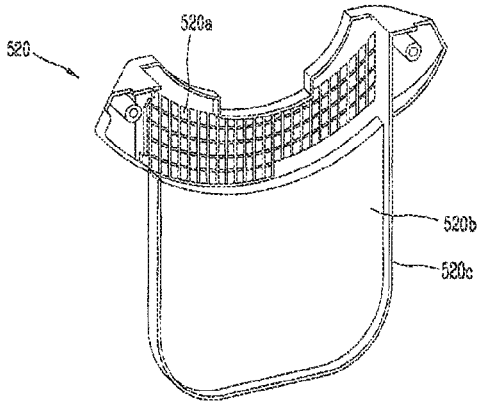
FIG. 9 is a perspective view showing a cover filter installed at the clothes dryer according to the present invention.
Figure 10:
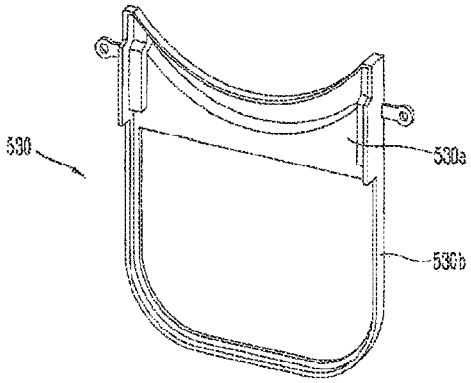
FIG. 10 is a perspective view showing a cover guide installed at the clothes dryer according to the present invention.
Figure 11:
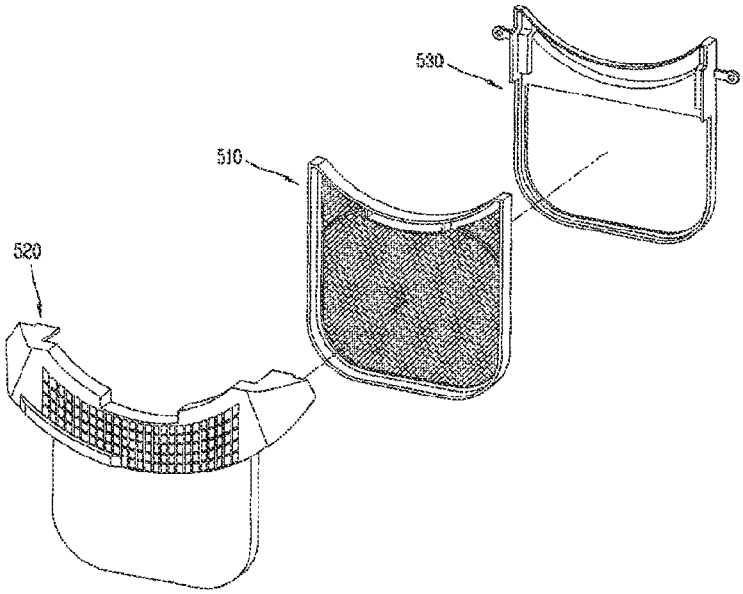
FIG. 11 is an exploded perspective view showing a filter assembly according to the present invention.

FIGS. 8 to 10 are perspective views showing a lint filter 510, a cover filter 520, and a cover guide 530 that constitute the filter assembly according to the present invention. FIG. 8 is an exploded perspective view showing the respective components.

The filter assembly of the present invention includes the lint filter 510, the cover filter 520, and the cover guide 530.

The lint filter 510 consists of a mesh portion 510*a*, and a mesh frame 510*b* configured to encompass the mesh portion 510*a*. And, the cover filter 520 consists of an upper side member having holes 520*a* through which the air exhausted from the drum is introduced into the filter assembly, and a lower side member downwardly extending from the upper side member. The lower side member of the cover filter 520 consists of a plate 520*b*, and a plate frame 520*c* protruding from the plate 520*b* and encompassing the plate 520*b*.

The lint filter 510 is configured to face the plate 520*b* of the cover filter 520, and is coupled to the cover filter 520. As the lint filter 510 and the cover filter 520 are coupled to each other, formed is a space encompassed by the lint filter 510 and the plate 520*b* of the cover filter 520. The space serves as a lint collector for collecting lint. That is, lint included in the air exhausted from the drum of the clothes dryer is collected by the lint collector.

The filter assembly may further include the cover guide 530 coupled to the cover filter 520 in a state that the lint filter 510 is disposed between the cover filter 520 and the cover guide 530.

The cover guide 530 has a similar shape as the cover filter 520, and consists of an upper side member 530*a* and a lower side member 530*b*. The lower side member 530*b* consists of an opening through which air passes, and an edge portion configured to encompass the opening. Air having passed through the mesh portion 510*a* of the lint filter 510 passes through the opening of the lower side member 530*b* of the cover guide 530.

A guide groove may be formed at the lower member 530*b* of the cover guide 530. And, the lint filter 510 may be coupled to the cover guide 530 under guide of the guide groove of the cover guide 530.

The guide groove for guiding the lint filter 510 may be formed not only at the lower side member 530*b* of the cover guide 530, but also at the plate frame 520*c* of the plate 520*b* of the cover filter 520.

Figure 12:
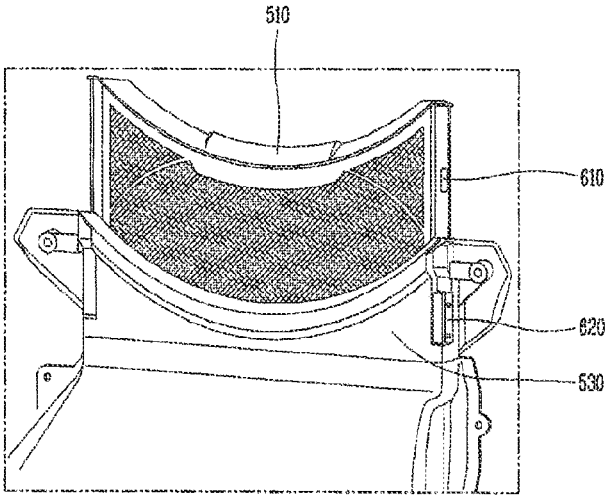
FIG. 12 is a view showing the filter assembly provided with means to detect whether the lint filter has been mounted to a precise position or not according to the present invention.

FIG. 12 is a view showing the filter assembly provided with means to detect whether the lint filter 510 has been mounted to a precise position or not according to the present invention. Preferably, the sensing means consists of a magnet 610, and a reed switch 620 for sensing the magnet 510. Also, it is preferable that the magnet 610 is mounted to a side surface of the lint filter 510, and the reed switch 620 is mounted to a side surface of the cover filter 520 or the cover guide 530.

Hereinafter, will be explained processes for collecting lint by the filter assembly according to the present invention.

The filter assembly has a structure that the cover filter 520 and the cover guide 530 are coupled to each other in a state that the lint filter 510 is disposed therebetween. The air exhausted from the drum passes through the holes 520*a* formed at an upper part of the cover filter 520, thereby being introduced to the inside of the filter assembly, i.e., the lint collector between the lint filter 510 and the lower side member 520*b* of the cover filter 520. Then, the air having been introduced into the lint collector is introduced into a duct via the mesh portion 510*a* of the lint filter 510. Here, lint included in the air is collected in the mesh portion 510*a* of the lint filter 510.

In the present invention, the lint filter 510 that forms a lint collecting space, and the cover filter 520 are formed of the same material. Accordingly, the lint filter 510 and the cover filter 520 may be fabricated in the same shape. This may enable the lint filter 510 and the cover filter 520 to have a more effective sealed state therebetween. Therefore, can be prevented air leakage to other parts inside the lint collector, rather than the mesh portion 510*a* of the lint filter 510. Preferably, the lint filter 510 and the cover filter 520 are formed of plastic molding material.

The filter assembly of the present invention may further include sensing means for sensing whether the lint filter 510 has been mounted to a precise position or not before the clothes dryer operates. After the sensing, the clothes dryer can operate. Referring to FIG. 9, the sensing means includes a magnet 610 mounted to a side surface of the lint filter 510, and a reed switch 620 mounted to a side surface of the cover guide 530. The reed switch 620 may be mounted to a side surface of the cover filter 520.

In the case that the lint filter 510 has been mounted to a precise position, the reed switch 620 sends a signal to a controller of the clothes dryer, thereby allowing the clothes dryer to normally operate. If the lint filter 510 has not been mounted or has been mounted to an imprecise position, the reed switch 620 can not sense the magnet 610 thus to send an error signal to the controller of the clothes dryer. Then, an error message is displayed on an adjustment panel disposed on a front surface of the clothes dryer, thereby allowing a user to easily recognize whether the lint filter has been mounted to a precise position or not.

The filter assembly of the clothes dryer according to the present invention may be applied to all types of clothes dryer as long as it has a structure to perform a filtering process for removing lint included in the air exhausted from the drum of the clothes dryer. That is, the filter assembly of the present invention may be applied not only to a ductless type clothes dryer or a condensation type clothes dryer, but also an exhaustion type clothes dryer.

It will also be apparent to those skilled in the art that various modifications and variations can be made in the present invention without departing from the spirit or scope of the invention. Thus, it is intended that the present invention cover modifications and variations of this invention provided they come within the scope of the appended claims and their equivalents.

The invention claimed is:

1. A clothes dryer, comprising:

a body;

a drum rotatably installed at the body;

a duct for guiding air exhausted from the drum; and a filter assembly disposed at the duct, for filtering lint included in the air exhausted from the drum, wherein the filter assembly comprises:

a cover filter comprising an upper side member having holes through which the air exhausted from the drum is introduced into the filter assembly, and a nonporous plate downwardly extending from the upper side member;

a lint filter configured to face the nonporous plate of the cover filter;

a lint collector encompassed by the lint filter and the nonporous plate of the cover filter; and a cover guide coupled to the cover filter in a state that the lint filter is disposed between the cover filter and the cover guide.

2. The clothes dryer of claim 1, wherein the lint filter comprises:

a mesh portion; and a mesh frame configured to encompass the mesh portion.

3. The clothes dryer of claim 1, wherein the cover filter further comprises:

a plate frame protruding from the nonporous plate and encompassing the nonporous plate.

4. The clothes dryer of claim 3, wherein a guide groove is formed at the plate frame of the cover filter, and the lint filter is coupled to the cover filter under guide of a guide groove of the cover filter.

5. The clothes dryer of claim 1, wherein the cover guide comprises:

an opening through which air passes; and an edge portion configured to encompass the opening, and having a shape corresponding to that of the mesh frame of the lint filter.

6. The clothes dryer of claim 5, wherein a guide groove is formed at the lower side member of the cover guide, and the lint filter is guided by the guide groove of the cover guide.

7. The clothes dryer of claim 1, wherein the filter assembly further comprises sensing means for sensing whether the lint filter has been mounted to the cover guide or the cover filter or not.

8. The clothes dryer of claim 7, wherein the sensing means comprises:

a magnet mounted to the lint filter; and a reed switch mounted to the cover filter or the cover guide.

* * * * *